United States Patent [19]

Alimbau

[11] Patent Number: 4,493,392

[45] Date of Patent: Jan. 15, 1985

[54] CONVERTIBLE FOLD-UP LADDER

[76] Inventor: Salvador Alimbau Marques, San Elias 21 3°, Barcelona 6, Spain

[21] Appl. No.: 537,276

[22] Filed: Sep. 29, 1983

Related U.S. Application Data

[63] Continuation-in-part of Ser. No. 341,830, Jan. 22, 1982, Pat. No. 4,457,391, and a continuation-in-part of Ser. No. 417,382, Sep. 13, 1982, Pat. No. 4,429,766, and a continuation-in-part of Ser. No. 492,487, May 6, 1983, Pat. No. 4,448,283.

[51] Int. Cl.[3] ..... E06C 1/383

[52] U.S. Cl. ..... 182/27; 182/164; 182/196; 182/211

[58] Field of Search ..... 182/163, 164, 24, 23, 182/196, 197, 198, 156, 22, 23, 24, 27

[56] References Cited

U.S. PATENT DOCUMENTS

| | | | |
|---|---|---|---|
| 303,884 | 8/1884 | Reisener | 182/164 |
| 308,179 | 11/1884 | Linnenbrink | 182/164 |
| 1,644,739 | 10/1927 | McCracken | 182/164 |
| 2,529,112 | 11/1950 | Steele | 182/164 |
| 3,216,526 | 11/1965 | Cole | 182/163 |
| 3,554,318 | 1/1971 | Knight | 182/163 |
| 3,655,012 | 4/1972 | Hoffmann | 182/163 |
| 3,730,295 | 5/1973 | Deese | 182/163 |
| 3,811,151 | 5/1974 | Kummerlin | 182/163 |

FOREIGN PATENT DOCUMENTS

| | | | |
|---|---|---|---|
| 433724 | 8/1935 | United Kingdom | 182/163 |

*Primary Examiner*—Reinaldo P. Machado

[57] ABSTRACT

A portable folding ladder comprising a plurality of U-shaped modules having a rung and two vertical portions, the modules movable connected to each other, and when opened becoming progressively narrower as they approach the top of the ladder, when folded the narrower modules fitting inside of the next wider modules and locking means to lock the modules in a rigid manner when the ladder is extended and open.

19 Claims, 10 Drawing Figures

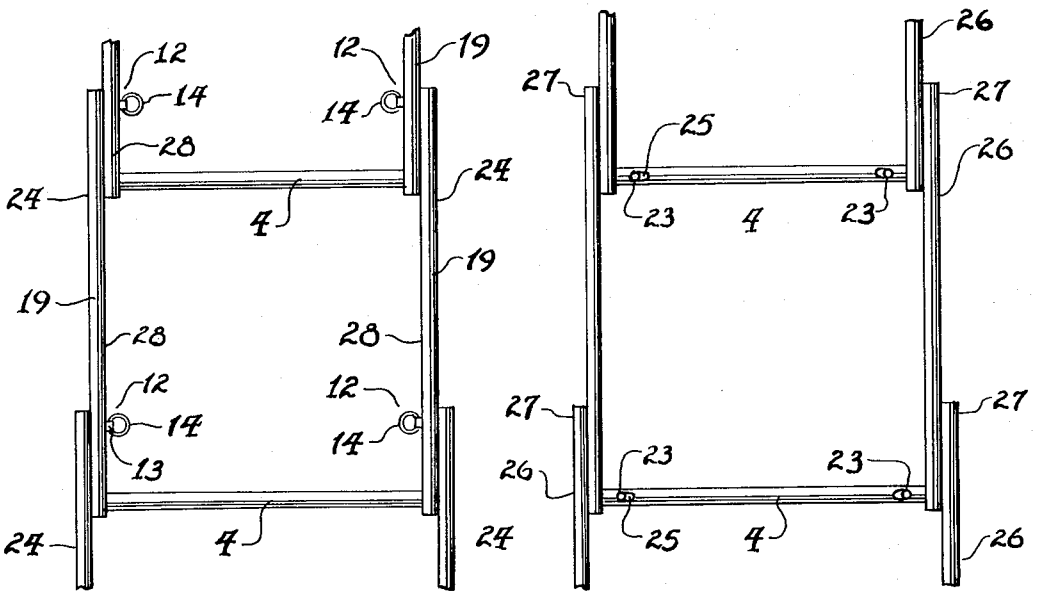
Fig. 5
Fig. 4
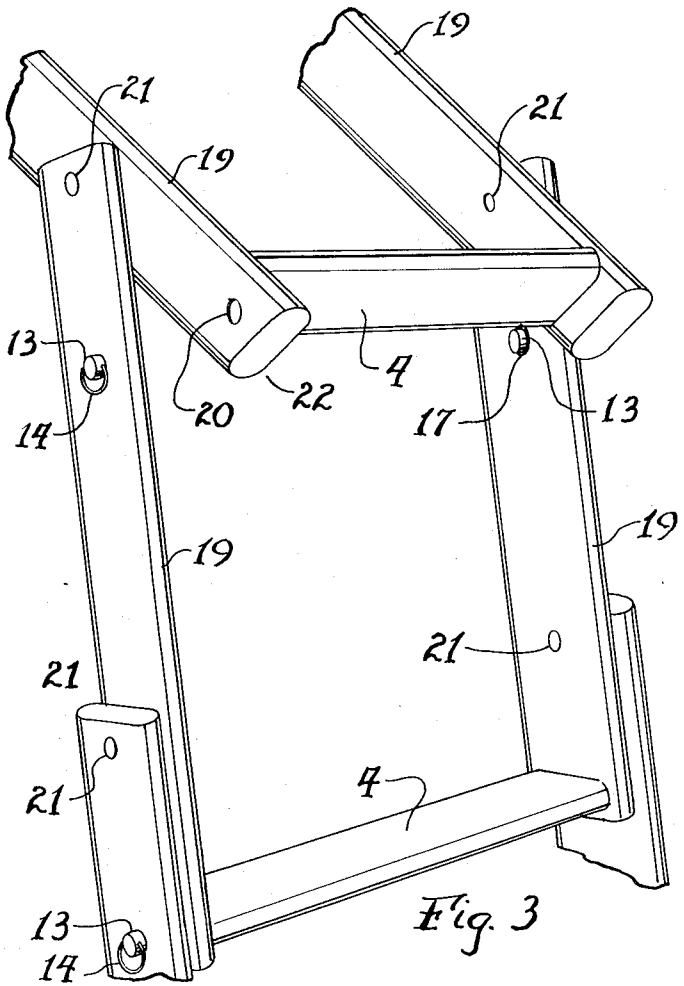
Fig. 3

CONVERTIBLE FOLD-UP LADDER

This invention relates generally to a new ladder and more specifically to a new portable, convertible and fold-up ladder. This application is a continuation-in-part of U.S. applications Ser. No. 06/341,830 filed Jan. 22, 1982 now U.S. Pat. No. 4,457,391, Ser. No. 06/417,382 filed Sept. 13, 1982 now U.S. Pat. No. 4,429,766 and Ser. No. 06/492,487 filed May 6, 1983 now U.S. Pat. No. 4,448,283.

BACKGROUND OF THE INVENTION

It is known to use various forms of collapsible and fold-up ladders for both domestic and commercial use. Many of these prior art ladders are very bulky when collapsed and could be extremely difficult to carry. Generally, these ladders require time-consuming and difficult processes for disengaging the ladder after use and are too bulky for easy storage. Correspondingly, most of these known ladders are troublesome to set up for use after storage.

Collapsible ladders on the market today consist of sections of several rungs which are almost of the same length as that of the main base strut or rung of the portable ladder itself. These struts or rungs are linked by clamps to the side rails between which the struts or rungs are placed.

These clamps secure the struts of the main and secondary sections allowing the extension of this secondary section from the main section. By pulling the secondary sections out from the main section along the clamps, the ladder is extended to its maximum width. These ladders are known as extension ladders and have a compacted size of at least the size of the main section. They are often difficult to extend and are even more difficult to compact.

Another design consists in linking both long sections, main and secondary on their ends by a hinged joint.

These ladders are not structurally secure and need to be of a length again no shorter than the length of the main section. Nevertheless, this second embodiment is less reliable for the use of the ladder, as the securing lugged nut at the hinges has to exert a great pressure in the aligned position in order to avoid the collapsing of the end of the ladder once it has been subject to the load of the person stepping on the additional top section. Therefore, this model is still less safe than the first. Nevertheless, both show the drawback of the difficulty of handling because of their weight and bulkiness. Neither configuration is small enough to fit into the trunk of a car, or can easily be stored in a garage or shed.

As noted above, the presently available ladders have serious drawbacks when assembling for use, or disengaging for storage. In addition, they are relatively expensive to manufacture and not always structurally reliable when in use.

Typical fold-up ladders are disclosed in U.S. Pat. Nos. 3,216,526; 3,554,318; 3,655,012; 3,730,295; and 3,811,151.

There are also known chain type or link fold-up fire escape ladders that are not rigid but rather are intended to be flexible when extended for use. These ladders are generally suspended from windows by a hook or chain and dangle from an escape portal or window so people can descend therefrom. None of these ladders are adapted to be locked in a rigid structure nor can any be used as an ordinary lean-to or stepladder. Typical escape ladders of this type are disclosed in U.S. Pat. Nos. 303,884; 308,179; 1,644,739; 2,529,112 and in British Pat. No. 433,724 dated Aug. 20, 1935.

SUMMARY OF THE INVENTION

It is therefore an object of this invention to provide a convertible and portable ladder devoid of the above-noted disadvantages.

Another object of this invention is to provide a convertible ladder that is comparatively easy and relatively inexpensive to manufacture and can be converted into a multitude of configurations.

Another further object of this invention is to provide a compact ladder that is structurally sound and reliable for both domestic and commercial use.

A still further object of this invention is to provide a fold-up ladder that is relatively compact when folded, is easily stored or carried, and simple to fold down when not in use.

A further object of this invention is to provide a convertible ladder that can be completely folded for storage, can be extended and locked into a substantially rigid lean-to ladder easily carried from one location to another.

Another still further object of this invention is to provide a portable lightweight ladder that can be converted into a pushcart or a workbench.

Another further object of this invention is to provide a lightweight ladder that can be easily converted into stepladders or lean-to ladders of various lengths and designs, even in stepladders where the A-frames are of different lengths and lean-to ladders of various configurations.

The foregoing objects and others are accomplished in accordance with this invention by providing a novel fold-up portable ladder which comprises a plurality of U-shaped sections or modules that form both the rungs and side rails of a ladder when assembled. The cross-sectional configuration of the side rails are rounded or curved for easy modular locking. Each section or module is attached and hinged at its lower portion to the next adjacent wider section, the wider modules or sections are movably positioned below each of the narrower modules. Below or above said hinges are locking latches or slide bolts located in either the vertical side rails or any lower portion of the module adapted to fit into and mate with an aperture located in the upper portion or vertical rail of the said next wider adjacent section, the lowest of said U-shaped modules or sections being the widest and the top uppermost of said U-shaped sections being the narrowest. Each of said sections in-between the top and lowest sections are progressively narrower as they approach the said top section. The latches or bolts are spring loaded so that when aligned with and mated into the aperture they will remain in place and securely hold each module in position. To disengage each module, there is positioned in each module lower portion (except the lowest module) a spring and an external latch or lock release. When the latch releases are turned or pulled or moved, the latch or bolt is forced away from said apertures and releases each U-shaped modular section from the next adjacent section. The vertical or upright arms of each U-shaped section thus are connected to and aligned with the next section by the use of latches and apertures in the lower portion of the narrower module and the upper portion of the wider module of each U-shaped section. The latches in the horizontal base are aligned with and fit into the orifice or aperture in each module section adjacent to it. Also, the tips of each latch portion are tapered at their ends for each sliding into each orifice or aperture. It is preferred the latches be spring loaded, however, a conventional slide bolt lock can be used. In using spring loaded locks, the latch releases need not be manipulated when setting up the ladder, only when the ladder is to be folded up after use. This is achieved by forming the ladder from metal that is at least partially eliptical, curved, or rounded in cross-section and from bolts or latches having rounded or tapered ends.

Any suitable material may be used in the construction of the ladder; typical materials are steel, aluminum, iron, other metals or alloys or mixtures of metals; plastics such as polycarbonates, polyurethanes, polyesters, polyvinyl materials, or other suitable polymers or synthetic materials. Also wood, fiber glass, or other synthetic materials may be used if suitable.

The ladder of this invention is structurally sound, and is very compact when folded down. It folds down so that all of the modules are in substantially the same plane. It can fit in the trunk of a car easily, and can be carried without problems caused because of extending ladder portions. The ladder is made up of a plurality of U-shaped modules, each module comprising a base, rung (or horizontal) portion and two vertical (side rail) portions. The top module has an additional rung or horizontal piece above the base portion of its U-configuration. Positioned in each side wall are hinges movably connecting the lower part of a narrow U-shaped module to the upper part of the adjacent wider U-shaped module. Each module of the ladder with the exception of the lowest module has a locking means adapted to lock each module together into a substantially rigid structure when the ladder is extended or opened for use. This locking means comprises a spring mounted latch that can movably extend out from the inner or outer ends of the side rails or lower portion of each U-shaped module. These latches are spring loaded inside each module and can be moved within or beyond the inner or outer terminal ends of said modules to mate and lock with an aperture in the next adjacent module. When the ladder is to be in its extended and locked position, the latches are moved beyond the side rail or rung terminal ends and into an aperture located in an adjacent portion of the adjacent module. When the ladder is to be compacted, the latches are moved within the terminal portions of said module and out of locking contact with the aperture or orifice in the next adjacent module. Each module except the lowermost module has extending outwardly therefrom latch release means that are movably attached to said latches and are adapted to move said latches in any direction when desired. The preferred release means comprise extensions that can be turned, pulled, moved or pinched together when compacting the ladder, and can be turned or force moved in the opposite direction when extending the ladder for use. These end rounded latches are associated with springs which cause them, together with the curved surface of the ladder tubing or bar, to snap into the apertures when aligned therewith. The springs cause the latches to be easily moved into and out of the apertures when desired.

In one preferred embodiment of the invention, the side walls are curved to facilitate sliding of the latch into an aligned aperture in the next adjacent module. The wider adjacent module has integral therewith a spring-loaded latch or an aperture means that mates with the other mating element depending upon the structure desired. The variations will be described in reference to the draw- ings.

In another preferred embodiment of this invention, the side walls and rungs are round and fit in movable juxtaposition with the next adjacent module made from round pipe or metal. Any embodiment described herein can be formed from a pipe having a modified eliptical or a round cross-section.

In both of these embodiments, the portion of the locking means comprising the latch (or aperture) and latch release are located in the lower portion of the narrower U-shaped module. This latch will mate with an aperture or latch located in the upper portion of the next adjacent wider module. Also, both embodiments can be converted to stepladders merely by folding the ladders in approximately the center to provide two legs forming an A-shaped stepladder. Any portion of the ladder can be folded away to form stepladders or lean-to ladders of different leg lengths for use on stairs, or on surfaces having different heights. When compacted or folded down, the ladders have a rectangular configuration wherein each module is fitted inside the next adjacent module on the same plane. When extended and locked the ladder is rigid and can be used as any extension ladder or lean-to is used. The ladder can also be folded in two places to form a workbench or support having the widest and narrowest modules in contact with the floor. It can also be easily converted into a pushcart or dolly by folding in a J-like (modified) structure and attaching wheels to the lower focal portion. Wheels can be attached by nut and bolt attachment, or by pushing an axel through the apertures in side rails, or by any conventional wheel-attaching means.

More details of the particulars of these embodiments will be provided in the description accompanying the drawings.

BRIEF DESCRIPTION OF DRAWINGS AND DESCRIPTION OF THE PREFERRED EMBODIMENTS

The preferred embodiments of this invention are illustrated in the accompanying drawings and description.

FIG. 1A shows the lean-to ladder fully extended in locked position and having centrally located lock release means.

FIG. 1B shows ladder of 1A in a folded condition having centrally located latch or lock release means.

FIG. 3 shows another latch release means and locking means located in the approximate hinge location of FIG. 2 ladder.

FIGS. 4 and 5 show alternate latch release or locking means.

Figure 2B:
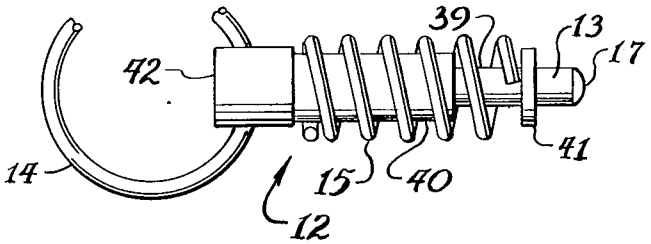
FIG. 2B is a side view of a latch.
Figure 2A:
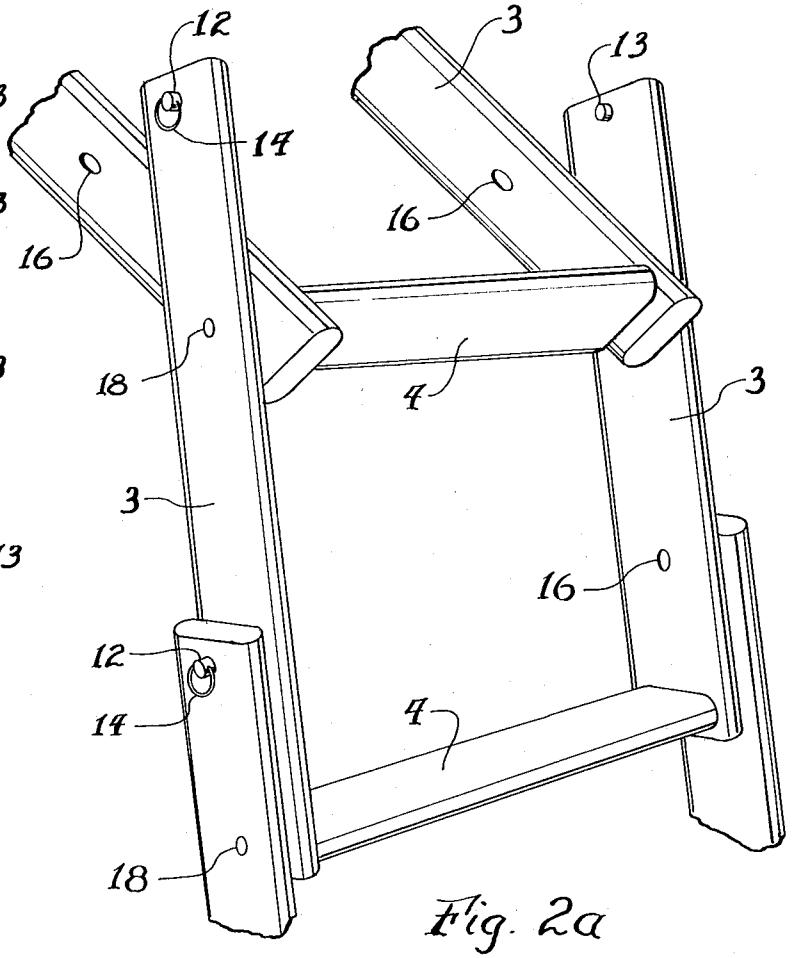
FIG. 2A shows the ladder in a sectional configuration with one pull-type latch release located in side rails.
Figure 1B:
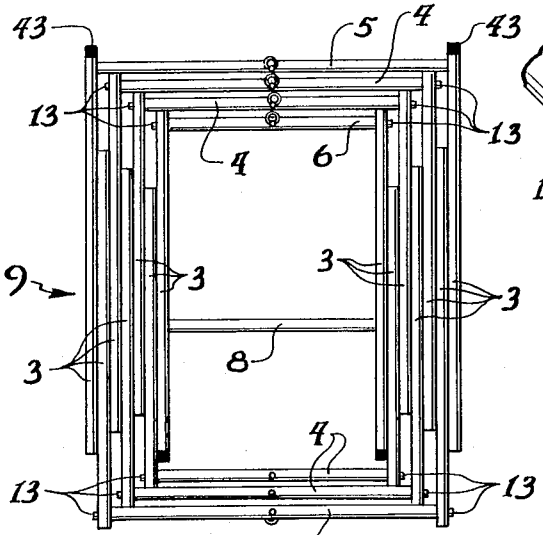
FIG. 1B shows the same ladder, after being folded down in one plane, and being adapted to be carried by the user on his shoulder or otherwise.
Figure 1A:
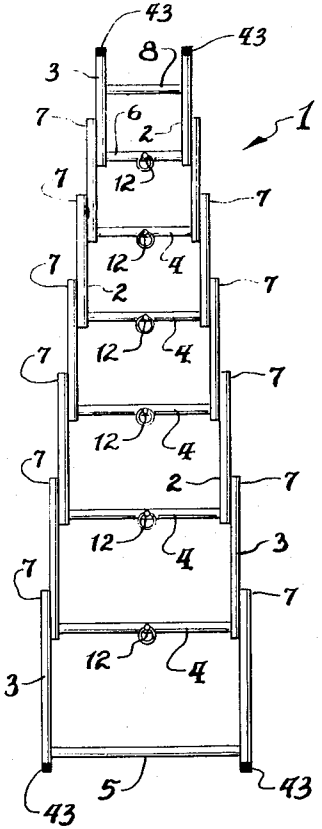
FIG. 1A shows a lean-to ladder in accordance with this invention, unfolded so that every modular U-shaped section is aligned and locked with respect to the foregoing one, being fixed through the corresponding retractable securing fasteners or latches.

In FIG. 1A, the invention consists of the U-shaped modular ladder 1 being made up of a multiplicity of U-shaped modules or sections 2, each module forming the shape of a rectangular frame lacking one of the smaller top laterals or opened at the top. The rungs are the lower horizontal arm of the U and the side rails are the two vertical arms of the U. This defines the true U-shape. Each of said modules has two vertical arms 3 and horizontal rungs or base portion 4. Each ladder has a plurality of these base portions or horizontal rungs 4 positioned between lowest module base portion 5 and upper module base portion 6. Upper module base portion 6 optionally could have above it another horizontal rung or portion 8 and thus is the only module having more than one integral horizontal portion or rung. This rung 8 is preferred (for extra holding support) to be included in ladder but it may be eliminated if desired. Each module is movably connected to the next adjacent module by hinge means 7 which are located at the upper portions of side rails or vertical arms 3 and the lower portion of the adjacent narrower U-shaped module. The hinges 7 may be located at any convenient part of side rails, for example, as shown in FIG. 2 at 18 if desired, thus the hinge could be located below the locking mechanism in some embodiments and above the locking mechanism in other embodiments. The ladder when it is compacted is folded into a rectangular form as shown at 9 in FIG. 1B. When compacted the ladder takes on the appearance of a plurality of rectangles fitted one inside the other, the rectangle formed by side rails 3 and lower base portion 5 forming the largest or outside rectangle, and the rectangle formed by side rails or vertical arms 3 and upper base portion or horizontal run 6 forming the innermost rectangle. The modules fold upon the hinges 7 (or in the alternative any hinge location such as the hinges 18 as shown in FIG. 2) when compacted and move open upon the hinges 7 when extended for use in locked position as in lean-to substantially rigid ladder shown in FIG. 1A. The modules pivot along hinges 7 and align each of the locking means elements so that they lock in place when the ladder is extended as in FIG. 1A. The latch portions 13 extend out from side rails 3 and are rounded or tapered at their end portions for easy mating with the aligned apertures. In FIG. 2A, a first embodiment of this invention is shown having a pull type lock release means 12. The locking means as shown in FIG. 2B comprises a spring-mounted pull slide bolt extension 13 having a tapered end 17 for easy sliding into aperture 16 and a pull ring 14 attached to the end for gripping. The lock release means and locking mechanism 12 shown in FIG. 2B is used in the embodiments illustrated in FIGS. 2A, 3 and 4. The locking mechanisms illustrated in FIGS. 1A, 1B, 6 and 8 are described in copending application Ser. No. 06/492,487. The locking mechanism shown in FIG. 5 is described in copending application Ser. No. 06/341,830. In FIG. 2B the lock release means 12 comprises a first portion 39 which fits into and is telescoped into wider latch portion 40. As 40 is pulled out spring means 15 causes portion 40 to snap back toward rivet head 41 when portion 40 is released. Rivet head 41 secures lock means 12 within the tubing forming the rails 3 or rungs 4. Only round or tapered end portions 17 and head 42 extend out from opposite ends of the tubing, and fit into the aligned side rail aperture 16 of FIG. 2A or 20 of FIG. 3 or appropriate aperture of FIG. 4. Lock release means 12 comprises a slide bolt 13 spring 15 loaded having a pull ring 14 or any other suitable grip means at its end position. When pulled, it releases the bolt 13 from the aligned aperture 16 in the next adjacent module and releases or unlocks the module one from the other. Latches or bolts 13 are the male element of said locking means that fit into the apertures 16 when aligned therewith. When disengaging the latches or bolts 13 from apertures 16, latch release means 12 are pulled outwardly away from the center of horizontal rungs 4 and away from apertures 16. Apertures 16 are located in this embodiment side walls 3 and are spaced one from the other in the substantially same distance of each rung 4 from each other. The latches 13 are located in and extend outwardly from side rails 3 and lock each module in position when the ladder is extended. Hinges 18 extend into both side rails of adjacent modules and provide means for folding the ladder when in a closed mode. Latches or bolts 13 are shown for clarity in FIG. 2B as if they were being pulled out from side rails 3, they are in fact flush with the outer surface of rails 3 when in locked or rested positions.

In FIG. 3, another embodiment of the present invention is shown having eliptical cross-sectioned side walls or rails 19. These rails 19 may also be curved or round or partially rounded if desired. The curved or rounded configuration in all embodiments illustrated herein permit easy sliding of tapered or rounded bolt or latches 17 into the aperture 20 aligned in the next adjacent module. The side walls 19 are connected together by hinges 21 which permit the side walls to pivot upon each other and permit 360° movement in relation to each other if desired. Hinge 21 is a bolt or rod flared at each end to securely hold each side wall or vertical arm 19 movably together. Hinges 21 permit free movement of each side wall 19 until latch 13 is aligned with and locked into aperture 20. In all embodiments of this invention apertures 20 can extend through the thickness of side walls 19 or optionally can be placed just in the outside surface as shown at location 22 in the extended portion of the ladder shown in FIG. 3. Latch release means 12 are movably connected to springs 15 located internally in side rails 19, and said springs 15 are movably attached to latches 13. When release means 12 are pulled, latches 13 are withdrawn from apertures 20 and the ladder is ready to be compacted or folded up as shown in FIG. 1B. When it is desired to extend the ladder in all embodiments for use, rung 8 as shown in FIG. 1, is merely pulled up, holding rung 5 down with your foot or any fixed object, and latches 13 because of their rounded ends 17 and because of the curved cross-section of the side rails, will lock with the aligned aperture as 20 in FIG. 3 presented to it. Lock or latch release means 12 need not be manipulated when the ladder is to be extended, only when the ladder is to be compacted. Guide means have been used prior to the present invention to facilitate bolts or latches sliding into apertures, this feature is shown in co-pending application Ser. No. 341,830 of which this application is a continuation in part. It is not necessary to have guide means in the present invention because of the curved cross-sectional configuration of side rails and rounded ends 17 of the latches. In FIG. 4, locking means 12 extends out from the inside of each module or inside surface of side rails 19. Rings 14 or any pull or turn or push device that releases the lock extends from inside rails 19. The hinge 24 is located adjacent rungs 4 in this embodiment but may be located at any convenient location. In FIG. 5, slide bolts 23 are positioned in the rungs 4 and may be pushed or slided along opening guide 25 slot into or out of locking engagement with the adjacent side rail 26. The lock may be a simple bolt lock or any other known locking means. Hinges 27 may be located at any convenient location on side rails 26.

In each embodiment of this invention, the ladder comprises U-shaped modules, each module comprising two rounded or curved vertical sides, rail, bars or walls 3 as shown in FIG. 1A and a horizontal rung 4 as shown in FIG. 1A. Positioned in each of said rails 3 are hinges 7 connecting the lower portion of said U-shaped modules to the upper portion of the next adjacent wider module. Locking means 12 are positioned in each U-shaped module to lock with the next adjacent wider module. The locks can be located in any portion of the U-shaped module that allow it to lock with any portion of the next adjacent wider module. It is preferred that the latches or locks 12 be in and extend from the vertical side rails of each module, but they can also extend from the horizontal rungs. The locking means 12 or 23 in each illustrated configuration comprises a latch male 13 member which extends outward from each module having a locking means. The female member or latch receiving member 16 or 20 is in the form of an aperture located in each base portion or vertical side rails of the module. Latch release means 12 are connected to said latches 13 and adapted to move said latches into and out of said latch receiving members 16 or 20. The latch release means 12 may comprise any suitable configuration such as the pinch or slide means 23 shown in FIG. 5 or the single lock release means 12 shown in FIGS. 2, 3 and 4. By turning, pinching, sliding, pushing, pulling, or otherwise moving said release means, latches, bolts or locks are moved into or out of said receiving members. The locking means or latches can be located either above or below the hinges in each of the embodiments of this invention. When the ladder is fully extended, it is substantially rigid and can be used against a wall in the same manner as any extension ladder or lean-to ladder. The ladder in every embodiment shown in all of the Figures can be converted into a step-ladder, workbench, pushcart or can be folded completely or partially, if desired.

The lock releases or latch release means can be manipulated, if desired, both when setting up modifications of the ladder for use and when folding up or compacting the ladder for storage or transportation. But, because of the tapered bolts or latch ends and the curved or rounded side rails, the modules will lock in place automatically when setting up the ladder. The components of the locking means of this invention comprise a latch release means, a latch or bolt and an aligned aperture.

The walk-up ladder of this invention when extended for use is rigid in substantially the same manner as a conventional ladder or an extension or stepladder. The side rails when in a locked position have substantially the same inflexibility as a rigid side rail when used in an extension or one-piece ladder. Thus, the side rails when locked in position simulate a one-piece side rail in terms of rigidness, inflexibility and firmness, but has the advantages of being capable of complete or partial folding when not in use. Also, the ladder can be converted into a pushcart, stepladder, or workbench or several other modifications depending on the required use. In the pushcart mode only the bracket and wheels need be attached.

When used as a stepladder, the A-frame rails also are substantially rigid and unyielding as in a conventional stepladder. The stiffness of the vertical side rails or bars when locked and upright permit the use of the ladder in any manner to which conventional one-piece walk-up ladders, extension ladders or stepladders are put.

The cross-sectional configuration of each module is curved to facilitate entrance of bolt or latch in the aperture in the next adjacent module. This cross-sectional configuration can be round or rounded, curved, eliptical or a modified eliptical structure. By "modified eliptical" is meant a structure where two opposite sides are substantially straight but terminate in a curved manner, for example, if the longitudinal sides of an elipse were made straight but the end portions were rounded. This could be called a "modified eliptical" configuration.

In FIG. 4 of the invention is shown wherein locking means 12 are located on the inside surface 28 of the side rails 24. Each of the locking means are shown in the drawing as if they were pulled out or away from side rails 3 or 19, before locking in position. Once locked in position, they would be recessed into the interior portion of side rails 3 and 19 and the exterior terminal portion 13 of the locking means when in locked position would be flush with or on the same plane as the surface of side rails 3 and 19. Since locking means 12 are spring-loaded, they will snap back into the side rails 3 and 19 once released and/or locked. Locking means 12 may be located at any location or position on side rails 3 and 19 as long as there is access to an aperture in the next adjacent module side rails to lock with. If desirable, locking means 12 may be positioned on the outside surface as shown in FIGS. 2 and 3 or may be in the form of a wraparound brace or bracket that wraps around the side rails of adjacent modules to lock them together. Hinges permit folding of the ladder when not in use.

In FIG. 5 the locking means 23 and 25 comprise a lock release means 23 which is slidably spring-mounted in contact with a latch (similar to that shown in FIG. 2B) that will mate with an orifice or aperture located in side rails 26. It could, however, be used without a spring if needed. To unlock, lock release 23 is slided toward the center of the ladder and to lock the lock release means 23 is pushed or slided toward side rails 26. Hinges 27 permit the U-shaped modules to be folded or inscribed inside the frame of the adjacent wider module when in a closed or folded mode. Each U-shaped module has the two side rails 26 hinged to the bottom portion of the next adjacent narrower module.

Figures 6, 7, 8:
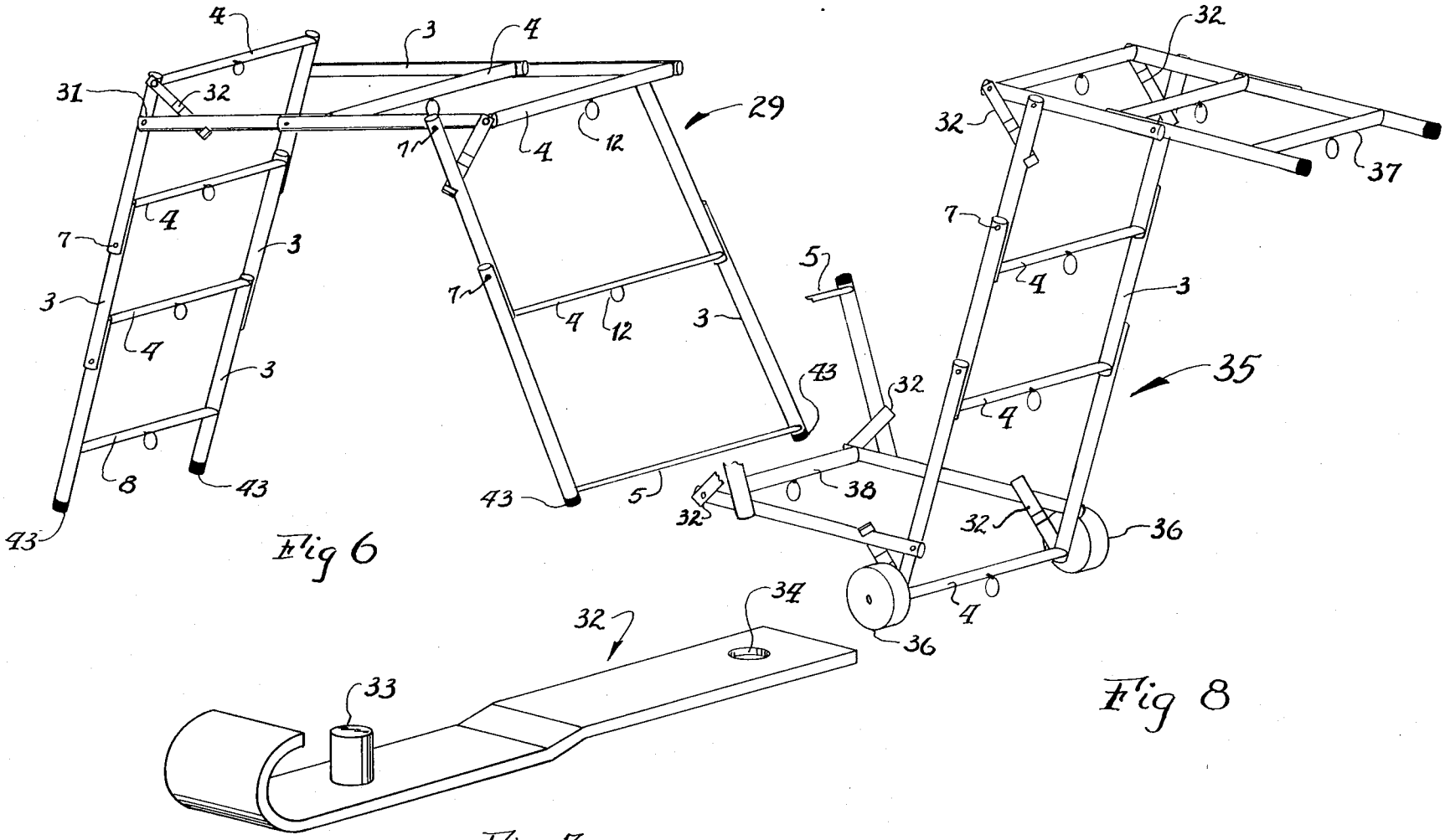
FIG. 6 illustrates the ladder when it is converted to a workbench.
FIG. 7 illustrates the bracket used with the ladder when converted into several modifications including the workbench of FIG. 6 or pushcart of FIG. 7.
FIG. 8 illustrates the ladder of FIG. 1A converted into a pushcart.

In FIG. 6 the workbench 29 configuration is shown, whereby the ladder of FIG. 1A is folded at a point 30 two modules from the top of ladder to form a platform or workbench configuration. Brackets 32 are used to lock and brace the folded portions in position. Rubber or other nonskid feet portions 43 are positioned on each leg or terminal portion of ladder. The bracket 32 as shown in FIG. 7 has a projection 33 on one end and an aperture 34 on the opposite end. The projection 33 will fit into an aperture in side rail 3 of the ladder and aperture 34 will mate with a latch 13 extending out from a module as shown, for example, in FIG. 2A. Two brackets 32 may be used one on each side or diagonal corners of workbench structure or four brackets 32 may be used rather than two as shown in FIG. 6. The workbench or platform configuration may be used for a multitude of purposes and in a variety of ways. Hinges 7 (of FIG. 1A) are locked in position by the use of brackets 32. The cross-sectional configuration of the tubing or bars used to construct all of the ladders shown in all of the Figures herein is preferred to be in a modified eliptical structure. This modified eliptical configuration is clearly shown in FIGS. 2 and 3.

In FIG. 8 the ladder is shown when it is converted into a pushcart 35. Any number of modules can be folded down to form a variety of pushcart configurations. Brackets 32 can be placed at the locations shown in FIG. 8 or the configuration shown in FIG. 6 inverted can be used as a handcart with the addition of four wheels. In FIG. 8 wheels 36 are placed at module fold and the modules secured in place by brackets 32. The wheels 36 can have projections that will lock into the apertures in the side rails 3. When converting the ladder to a pushcart, one, two, four or any number of wheels may be used. Any suitable wheel-connecting means may also be used. The narrower module or wider module may be used as the push handle 37 and the narrower or wide one or two modules may be used as the load carrier 38. Both the push handle portion 37 and the load carrier portion 38 are locked in position by brackets 32. The same bracket 32 as illustrated in FIGS. 6 and 7 may be used. Any known wheel structure or even two or four wheels with axels can be adapted for use with these push or handcarts shown in FIGS. 8 and the inverted structure of FIG. 6.

The preferred embodiments of the present invention have been described herein and shown in the accompanying drawings to illustrate the underlying principles of the invention, but it is to be understood that numerous modifications such as squared side rails or rungs rather than the preferred curved surface of modified eliptical cross-section of tubing may be used without departing from the broad spirit and scope of the invention.

What is claimed:

1. A convertible fold-up, lean to ladder comprising a plurality of U-shaped modules having means movably connecting each module to the next adjacent module, at least a portion of a locking means provided in said modules adapted to lock said modules together in a substantially rigid manner, said locking means comprising a latch, a latch release means and an aperture to mate with said latch, said latch located in a first module and said aperture located in the module immediately adjacent said first module, said latch having a rounded end portion and positioned in mating alignment with said aperture when said ladder is in its extended mode, the length of said modules having a curved outer surface to facilitate entrance of said latch into said aperture, the horizontal arms of said U-shaped modules defining the rungs of said ladder, at least a section of the wider modules overlapping at their upper vertical portions with the bottom portions of the next adjacent narrower modules, and said locking means and said module hinge means provided within said overlapping portions.

2. The convertible ladder of claim 1 wherein said modules have a modified eliptical cross-sectional configuration.

3. The convertible ladder of claim 1 wherein said modules have a curved cross-sectional surface.

4. The convertible ladder of claim 1 wherein said modules have a substantially round cross-sectional configuration.

5. The convertible ladder of claim 1 wherein said locking means are adapted to lock with the upper portion of the next adjacent and wider module.

6. The convertible ladder of claim 1 wherein said means movably connecting each module are hinges located in the approximate upper portion of the wider module and the approximate lower portion of the adjacent narrower module.

7. The convertible ladder of claim 1 wherein at least a portion of said locking means are located in the approximate upper portion of the wider module and the approximate lower portion of the adjacent narrower module.

8. The ladder of claim 1 wherein said locking means are located in each module above said means movably connecting each module to the next module.

9. The ladder of claim 1 wherein said locking means are located in each module below said means movably connecting each module to the next module.

10. A portable folding lean to ladder comprising a plurality of U-shaped modules comprising a rung and two vertical portions, said modules movably connected to each other, and when opened becoming progressively narrower as they approach the top of said ladder, when folded said narrower modules fitting inside of the next wider modules, said modules except for said widest base module comprising in their lower portions a complete module locking means and a module hinge means, said locking means fixing said modules in a rigid manner when said ladder is extended and open, said locking means integral with said modules and comprising latches adapted to movably fit into and mate with an aperture located in the upper sections of said vertical portions of said modules, at least a section of the wider modules overlapping at their upper vertical portions with the bottom portions of the next adjacent narrower modules, and said locking means and said module hinge means provided within said overlapping portions, the length of said modules having a curved outer surface to facilitate entrance of said latch into said aperture.

11. The ladder of claim 10 wherein a bracket is used, said bracket comprising an elongated bar having an aperture on one end portion and a projection on the opposite end portion.

12. The ladder of claim 10 wherein said locking means comprise spring loaded tapered latches adapted to fit into or out of said apertures when said latch release means are moved.

13. The ladder of claim 10 wherein said hinges are located in the modules above said locking means.

14. The ladder of claim 10 wherein said hinges are located in the module below said locking means.

15. The ladder of claim 10 wherein said latches are tapered at their end portions for easy entrance into said apertures.

16. The ladder of claim 10 wherein the narrower of said modules are adpated to be juxtapositioned within the wider of said modules when said ladder is in a folded down mode.

17. A bracket means adapted for use with the ladder of claim 11 comprising an elongated bar having a projection on the face of one terminal portion and having an aperture in the face of the opposite terminal portion.

18. The ladder of claim 10 as shown in FIG. 6 as it is converted into a workbench.

19. The ladder of claim 10 as shown in FIG. 6 and FIG. 8 as it is converted into a pushcart adapted to accommodate wheels on at least one of its focal portions.

* * * * *

UNITED STATES PATENT AND TRADEMARK OFFICE

CERTIFICATE OF CORRECTION

PATENT NO. : 4,493,392

DATED : January 15, 1985

INVENTOR(S) : Salvador Alimbau Marques

It is certified that error appears in the above-identified patent and that said Letters Patent is hereby corrected as shown below:

On the title page;

ASSIGNEE: Andral Corporation
Williamsville, NY 14221

ATTORNEY, AGENT OR FIRM: James J. Ralabate

Signed and Sealed this

*Twenty-fourth* Day of *September 1985*

[SEAL]

*Attest:*

*Attesting Officer*

DONALD J. QUIGG

*Commissioner of Patents and Trademarks—Designate*